US006436238B1

(12) United States Patent
Pitkänen et al.

(10) Patent No.: US 6,436,238 B1
(45) Date of Patent: Aug. 20, 2002

(54) PROCESS FOR PREPARING A PAPER WEB

(75) Inventors: Maija Pitkänen, Jyväskylä; Markku Leskelä; Stina Nygård, both of Lohja as.; Eeva Ånäs, Äänekoski, all of (FI)

(73) Assignee: M-real Oyj, Espoo (FI)

( * ) Notice: Subject to any disclaimer, the term of this patent is extended or adjusted under 35 U.S.C. 154(b) by 0 days.

(21) Appl. No.: 09/154,158

(22) Filed: Sep. 16, 1998

(30) Foreign Application Priority Data

Sep. 16, 1997 (FI) ..... 973705

(51) Int. Cl.[7] ..... D21H 11/00; D21H 13/00; D21H 15/00; D21H 17/00; D21H 19/00

(52) U.S. Cl. ..... 162/182; 162/183; 162/184; 162/9; 162/13; 162/175; 162/DIG. 11

(58) Field of Search ..... 162/182, 183, 162/184, 189, 190, 198, 204, 135, 141, 142, 148, 149, 150, DIG. 11, 175, 13, 9

(56) References Cited

U.S. PATENT DOCUMENTS

| | | | | |
|---|---|---|---|---|
| 1,624,492 A | | 4/1927 | Little et al. | |
| 1,824,837 A | | 9/1931 | Richter | |
| 3,556,110 A | | 1/1971 | Briskin et al. | 131/2 |
| 3,608,559 A | | 9/1971 | Briskin et al. | 131/2 |
| 3,640,285 A | | 2/1972 | Briskin et al. | 131/2 |
| 4,064,317 A | | 12/1977 | Fukuba et al. | 428/537 |
| 4,241,142 A | | 12/1980 | Kaliski et al. | 428/511 |
| 4,298,652 A | | 11/1981 | Suzuki et al. | 428/323 |
| 4,388,150 A | | 6/1983 | Sunden et al. | 162/175 |
| 4,390,509 A | | 6/1983 | Weston et al. | 423/313 |
| 4,430,159 A | | 2/1984 | Bubik et al. | 162/292 |
| 4,755,259 A | * | 7/1988 | Larsson | 162/178 |
| 4,798,653 A | * | 1/1989 | Rushmere | 162/168.3 |
| 5,007,964 A | | 4/1991 | Tsukisaka et al. | 106/464 |
| 5,118,533 A | | 6/1992 | Saji et al. | 427/366 |
| 5,120,365 A | | 6/1992 | Kogler | 106/415 |
| 5,158,806 A | | 10/1992 | Unger | 427/359 |
| 5,277,764 A | * | 1/1994 | Johansson et al. | 162/175 |
| 5,340,611 A | | 8/1994 | Kustermann et al. | 427/361 |
| 5,352,287 A | | 10/1994 | Wason et al. | 106/416 |
| 5,411,587 A | | 5/1995 | Willis et al. | 106/486 |
| 5,582,681 A | | 12/1996 | Back et al. | 162/5 |
| 5,599,427 A | | 2/1997 | Koivuranta et al. | 162/301 |
| 5,620,565 A | | 4/1997 | Lazorisak et al. | 162/72 |
| 5,656,133 A | | 8/1997 | Savia | 162/203 |

(List continued on next page.)

FOREIGN PATENT DOCUMENTS

| | | |
|---|---|---|
| DE | 44 11 987 A1 | 10/1995 |
| EP | 0 411 638 A1 | 2/1991 |
| EP | 0 461 768 A1 | 12/1991 |
| EP | 0 496 269 | 7/1992 |
| EP | 0 496 269 A2 | 7/1992 |
| EP | 0 515 757 A1 | 12/1992 |
| EP | 0 624 686 A1 | 11/1994 |
| EP | 0 716 931 A1 | 6/1996 |
| EP | 0 853 159 A1 | 7/1998 |
| EP | 0 908 557 A1 | 4/1999 |
| EP | 0 908 558 A1 | 4/1999 |
| EP | 0 908 561 A1 | 4/1999 |
| FI | 74215 | 10/1979 |
| FI | 63614 | 5/1980 |
| FI | 66221 | 3/1981 |
| FI | 67568 | 12/1984 |
| FI | 884196 | 3/1989 |
| FI | 96695 | 9/1989 |
| FI | 932475 | 5/1993 |
| FI | 961026 | 9/1997 |

(List continued on next page.)

OTHER PUBLICATIONS

Barzyk, D., et al., "Acidic Group Topochemistry and Fibre–to–Fibre Specific Bond Strength," *J. Pulp Paper Sci. 23(2)*:J59–J61 (Feb. 1997).

Dahlvik, P., et al., "Interactions in Coating Colors Induced by Temperature–Sensitive Cellulosic Polymer," Intl. Paper and Coating Chem. Symp., Ottawa, Canada, pp. 155–162 (Jun. 1996).

Malinen, R., "Recent trends in kraft pulping in Finland," *Paper and Timber 75(1–2)*:14–19 (1993).

Sundberg, K., et al., "Interactions between simple electrolytes and dissolved and colloidal substances in mechanical pulp," *Pulp Paper Res. J. 9(2)*:125–128 (1994).

European Search Report for European Application No. EP 98 66 0001.3.

*Patent for Inventions,* Abridgments of Specifications, Herlad Printing Works, York, 1954, Abstract for U.K. Patent No. 623,357, p. 39.

*Patent for Inventions,* Abridgments of Specifications, Herlad Printing Works, York, 1954, Abstract for U.K. Patent No. 609,927, pp. 141–142.

Dialog File 351 (World Patents Index) English language abstract of FI 884196, WPI Accession No. 89–087231/12.

(List continued on next page.)

*Primary Examiner*—Stanley S. Silverman
*Assistant Examiner*—Mark Halpern
(74) *Attorney, Agent, or Firm*—Kubovcik & Kubovcik

(57) ABSTRACT

The present invention concerns a process for preparing a paper web. According to the process a pulp is formed from a fibrous raw material, a web is formed from the pulp and it is dried on a paper machine. According to the invention the pulp is formed from a mechanical pulp produced from a peroxide bleached mechanical wood raw material of the genus Populus, the pH of proportioning of the mechanical pulp being set at 6.8 to 7.2 and the machine pH at 7.1 to 7.5 and the conductivity of the pulp being set at 1000 to 1500 $\mu$S/cm. By using a relatively low pH value and a narrow pH range it is possible to diminish the sensitivity to disturbances of the paper making process. According to the present invention a mechanical aspen pulp can be combined with chemical pulp for preparing base paper of fine paper, whereby the mechanical pulp gives a high conductivity on the machine which improves the stability of the wet end and enhances water removal.

15 Claims, 3 Drawing Sheets

U.S. PATENT DOCUMENTS

| | | | | | |
|---|---|---|---|---|---|
| 5,725,732 | A | | 3/1998 | Cooper, III | 162/72 |
| 5,755,871 | A | | 5/1998 | Husson, Sr. | 106/487 |
| 5,755,930 | A | * | 5/1998 | Satterfield et al. | 162/164.1 |
| 5,766,419 | A | | 6/1998 | Linsuri et al. | 162/301 |
| 5,893,372 | A | | 4/1999 | Hampl, Jr. | 131/365 |
| 5,902,453 | A | | 5/1999 | Ruch | 162/135 |
| 5,925,446 | A | | 7/1999 | Matsuda et al. | 428/219 |
| 5,997,626 | A | | 12/1999 | Wu et al. | 106/486 |
| 6,004,467 | A | | 12/1999 | Bleakley | 210/717 |
| 6,156,118 | A | | 12/2000 | Silenius | 106/501.1 |

FOREIGN PATENT DOCUMENTS

| | | | |
|---|---|---|---|
| FR | 2 468 688 | | 5/1981 |
| GB | 496 775 | | 12/1938 |
| GB | 1 001 778 | | 8/1965 |
| GB | 1 030 195 | | 5/1966 |
| GB | 2 189 714 | | 11/1987 |
| GB | 2 262 542 | A | 6/1993 |
| JP | 52-032975 | | 3/1977 |
| SE | 8 904 337 | A | 6/1991 |
| SE | 500 472 | | 1/1992 |
| SE | 9 202 072 | A | 4/1994 |
| WO | WO 85/03316 | | 8/1985 |
| WO | WO 95/28522 | | 10/1995 |

OTHER PUBLICATIONS

"ACAV A2 Applications for: Blade Coating, Film Coating, Reverse Gravure," ACA Systems Ltd., Polvijärvi, Finland [retrieved on Jan. 31, 2001]. Retrieved from the Internet: <URL: http://www.aca.fi/html/body_applications.html> 30 pages + 1 page "Welcome to ACA Systems" showing site last modified Aug. 20, 2000.

Anas, E., et al., "Composition of nonpolar extractives in bark of Norway spruce and Scots pine," *J. Wood Chem. Technol. 3*:119–130, Marcel Dekker, Inc (1983).

Casey, J.P., "Pulp and Paper: Chemistry and Chemical Technology," 3rd ed., vol. IV, pp. 2481–2484 (1983).

Grön, J., and Rantanen, R., "Surface sizing and film coating," Chapter 25 in *Pigment Coating and Surface Sizing of Paper,* Lehtinen, E., ed., Papermaking Science and Technology, Fapet Oy, Jyväskylä, Finland (2000) pp 489–541.

"Handbook for Pulp and Paper Technologist," 2nd ed., Smook, G.A., Angus Wilde Publications, pp. 43–44 (1992).

Høydahl, H.–E., "Termomekanisk masse—en motessak eller et arealistisk fiberalternativ?" *Norsk Skogind. 29 (12)*:323–328, Selvig Publishing, Oslo, Norway (Dec. 1975).

Kärenlampi, P., "Tensile Strength of a Mixture of Two Pulps," *J. Pulp Pap. Sci. 21(12)*:J432–436 (Dec. 1995).

Liimatainen, H., et al., "Pressurized Grinding Improves the Potential of the Populous Family as a Raw Material for Value Added Papers," SPCI Aticelca May 19–22, Bologna, Italy, pp. 312–333 (1993).

Pirkko, O., and Hannu, S., "Papermaking Science and Technology," in Printing, Book 13, Gullichsen, J., et al., eds., Finnish Paper Engineers' Association and TAPPI (Publishers), pp. 133, 159–160, 213–214, 257, 263–272 (1998).

Pisarevskaya, E. A. et al., "Production of bleached aspen groundwood at the Zhidachev Mill," *Bumazh. Prom. 1*:17–18 (Jan. 1981).

Co–pending U.S. Application No. 09/266,936, filed Mar. 12, 1999.

Richardson, C. A., "TMP (Thermomechanical pulp) in coating base stock," CPPA Ann. Mtg. (Montreal) Preprints 63B:49–51 (Feb. 1977).

Vulchev, V. et al., "Manufacture of groundwood from chips," *Tseluloma Khartiya 9 (4)*:5–9 (1978).

Willard, H.H., and Boldyreff, A.W., "The Determination of Calcium by Ignition of Calcium Oxalate to Carbonate in Air," *J. Am. Chem. Soc. 52*:1888–1892, American Chemical Society (1930); XP000891670.

Zaki, M.I., and Abdel–Khalik, M., "Thermal Decomposition and Creation of Reactive Solid Surfaces. II. Textural Consequences of the Thermal Decomposition of Alkaline Earth Oxalates," *Colloids Surfaces 13*:323–332, Elsevier Science Publishers B.V. (1985); XP000892974.

Dialog File 351 (World Patents Index): Derwent English language abstract of JP 52–032975 (Document AN2), WPI Accession No. 1977–28374Y.

Dialog File 351 (World Patents Index): Derwent English language abstract of FI Patent No. 74215, Application No. 791379 (Document AO2), WPI Accession No. 79–81186B/197945.

Dialog File 351 (World Patents Index): Derwent English language abstract of FI Patent No. 63614, Application No. 793370 (Document AP2), WPI Accession No. 80–35899C/198020.

Dialog File 351 (World Patents Index): Derwent English Language abstract of FI Patent No. 66221, Application No. 8002938 (Document AL3), WPI Accession No. 81–25892D/198115.

Dialog File 351 (World Patents Index): Derwent English language abstract of FR 2 468 688 (Document AM3), WPI Accession No. 81–50171D/198128.

English language abstract of FI Patent No. 67568 (Document AN3).

Dialog File 351 (World Patents Index): Derwent English language abstract of FI 96695 (Document AL4), WPI Accession No. 89–265340/198937.

English language translation of the specification of 8 904 337 (Document AM4).

English language abstract for SE Patent No. 500 472 (Document AP4).

Co–pending U.S. application No. 09/309,604, filed May 11, 1999.

Dialog File 351 (World Patents Index): Derwent English language abstract of FI 932475 (Document AN5), WPI Accession No. 92–219675/27.

Dialog File 351 (Derwent World Patents Index) Derwent English language abstract of SE 9 202 072 A (Document AP5), WPI Accession No. 1994–125024/199415, XP002130598.

English language abstract of DE Patent No. 44 11 987 A1 (Document AM6).

Dialog File 351 (World Patents Index): English language abstract of FI 961026 (Document AP6), WPI Accession No. 97–437502/199741.

Dialog File 240 (Paperchem): English language abstract for Hoydahl, H.–E., "Thermomechanical pulp—fashionable or realistic fiber alternative," Norsk Skogind. 29(12):323–328 (Dec. 1975), (Document AS5), Caeser Accession No. 2935; XP002086903.

Dialog File 240 (Paperchem): English language Abstract for Pisarevskaya, E. A. et al., "Production of bleached aspen groundwood at the Zhidachev Mill," *Bumazh. Prom. 1*:17–18 (Jan. 1981), (Document AT6), Caeser Accession No. 2921; XP002086900.

Dialog File 240 (Paperchem): English language for Vulchev, V. et al., "Manufacture of groundwood from chips," *Tseluloza Khartiya 9(4)*:5–9 (1978), (Document AT7), Caeser Accession No. 2924; XP002086901.

Dialog File 240 (Paperchem): English language abstract for Karenlampi, P., et al., "Tensile Strength of a Mixture of Two Pulps," *J. Pulp Paper Sci. 12*:J432–436 (Document AT5), Paperchem Accession No. AB6613855.

Dialog File 240 (Paperchem): English language abstract for Richardson, C.A., "TMP (Thermomechanical pulp) in coating base stock," CPPA Ann. Mtg. (Montreal) Preprints 638:49–51 (Feb. 1977), (Document AS7), Paperchem Accession No. AB4807185; XP002086902.

Dialog File 351 (World Patents Index): English language abstract of SE 8 904 337 A (Document AM4), WPI Accession No. 1991–278919.

Dialog File 35 (Dissertation Abstracts Online): Abstract of: Simulation of Particle Packaging for Modelling the Light Scattering Characteristics of Paper (Optical, Sheet Structure); Leskela, Markku Johannes; Ph.D. Dissertation 1997; vol. 59/02–C of Dissertation Abstracts International, p. 454; Teknillinen Korkeakoulu (Helsinki), Finland (5766); Helsinki University of Technology, Laboratory of Paper Technology, P.O. Box 6300, FIN–02015, Hut, Finland.

* cited by examiner

COD as a function of pH and conductivity

LC turbidity as a function of pH and conductivity

PROCESS FOR PREPARING A PAPER WEB

BACKGROUND OF THE INVENTION

1. Field of the Invention

The present invention concerns a process claim 1 for producing a paper web.

2. Description of Related Art

According to a process of this kind a fibrous raw material is slushed and the stock obtained is formed into a web which is dried.

In paper making, mechanical pulps are used for, e.g., newsprint and SC and LWX papers. Compared to chemical pulp the particular advantage of mechanical pulps are their lower production costs and greatly yields. Entirely new fields of applications are also being found for mechanical pulps, in particular hardwood pulps. In connection with the present invention it has been found that by using mechanical pulps made from aspen it is possible to manufacture qualities of fine papers that are essentially better than the present ones. At the same time, this leads to conditions of web formation that are, however, distinctly more difficult than for conventional fine papers and for newsprint prepared from spruce. The present invention relates to the control of these web forming conditions.

In comparison to chemical pulps there are some considerable problems relating to mechanical pulps, such as high concentrations of LC substances (liquid and colloidal substances), amounting to 2000 to 8000 mg/l (when purely chemical pulps are used the corresponding amounts are 500 to 1000 mg/l). The high concentrations of disturbing substances increase the risk of disturbances to runability. The concentrations of lipophilic extractives which are particularly troublesome as regards runability are four times, or even up to seven times larger in bleached mechanical pulps than in chemical pulps. The lipophilic extractives are the main cause for most of the precipitates, stains and hole on a paper machine.

The brightness of a paper containing mechanical pulps is lower and the brightness stability poorer than for a traditional fine paper containing solely chemical pulps. The large concentration of fines in the mechanical pulps in both an advantage and a disadvantage. It renders the paper a good bulk, because it has a large scattering capacity, and it gives the paper high opacity, but for the runability of the paper machine a high fines concentration is a disadvantage. The fines have a large specific surface which consumes a lot of the various paper chemicals, both process chemicals and functional chemicals. It is also necessary to use large amounts of chemicals in webs containing abundant amounts of fines in order to control dewatering. The fines have a large specific surface and they impair dewatering of the web during paper manufacture.

The risk of pitch trouble increases in particular in the presence of bivalent or multivalent metal ions. These are capable of precipitating pitch already at small concentrations. In particular calcium gives rise to problems in processes wherein calcium carbonate has been used as a filler or a coating pigment and when mechanical pulp is employed.

Mechanical pulps are produced from softwood, primarily spruce, and to a lesser extent from hardwood, such as aspen (lat. *Populus tremula*). The pulps produced from different wood species contain varying amounts of lipophilic extractives. The extractives concentration of bleached spruce groundwood (PGW) is about 0.30 to 0.35% and of bleached aspen pressure groundwood 0.60 to 0.70%. Also the composition of the extractives is different for hardwood and softwood. Thus, spruce groundwood contains large amounts of free resinous acids, free fatty acids, fatty acid esters and free and esterified esters. The composition of the lipophilic extractives of aspen groundwood differs from that of spruce. In the extractives fraction of aspen groundwood the fatty acid esters dominate, there are only small amounts of free fatty acids and no resin acid can be found in the extractives of hardwood.

Because of the high concentration of extractives in mechanical aspen pulp, mechanical pulps produced from aspen have been considered to involve great runability risks.

There are also other problems associated with the use of aspen in paper making. The stone cells of the inner layer of the bark, i.e. the sclerides, have made it difficult to use aspen in chemical pulps and problems have also been caused by bark trash of aspen pressure groundwood. Furthermore, some 24 to 26% of the aspen cells are vasculum cells, which increase the risk of runability problems when using aspen pulp. The small vasculum cells of aspen have been found to cause spot and stain formation on the web.

In comparison to spruce, hardwood have a higher water retention (WRW) and the smaller fibres give a denser web. Both these factors reduce the dewatering of the web. The benefit of aspen compared to spruce is its lower lignin concentration which gives a higher brightness and improved brightness stability. Aspen would therefore be an interesting wood raw material in pulp making but for the above reasons and because of the smaller strength of aspen in comparison to spruce, the use of aspen has not increased in mechanical pulps. The relative of aspen, the poplar (lat. *Populus balsamea*), is to some extent employed for production of groundwood pulps in Northern America, but the same kind of runability problems also appear in connection therewith.

BRIEF SUMMARY OF THE INVENTION

It is an object of the present invention to eliminate the problems related to the prior art and to provide an entirely novel solution for utilizing mechanical pulp produced from aspen in paper making, in particular for production of a base paper for a new generation of fine papers. In particular, the present invention concerns a solution for controlling the clearly more difficult web forming conditions of aspen. Higher brightness and brightness stability are required of fine papers. On a higher brightness level it is more critical to control e.g. the formation of stains and spot caused by pitch.

DETAILED DESCRIPTION OF THE INVENTION

The invention is based on the following surprising findings, which have made it possible substantially to improve the runability of aspen mechanical pulp on a paper machine.

The amounts of organic matter dissolving from groundwood and other mechanical pulp and the variations of these amounts can be restricted by maintaining the pH of the paper machine relatively low and within a relatively narrow range. In addition to the low pH it is further possible to limit the amount of soluble total organic matter (COD) and the amount of organic anionic impurities by maintaining a relatively high conductivity.

The relatively low pH and the relatively high conductivity are particularly advantageous as regards the pitch substance which disperses into water from aspen groundwood.

According to Sundberg et al. (K. Sundberg, J. Thornton, R. Ekman, B. Holmbom, Nord. Pulp Pap. Res. J. 9(1994) 2, 125–128) dispersion of pitch from pulp to water is promoted by the fact that the carbohydrates dissolving in water from pulp (spruce groundwood—TMP) sterically stabilize the pitch dispersion. When operating a process according to our invention the high conductivity restricts the solubility of the organic substance and when the concentration in water of the substance which stabilizes the pitch dispersion drops, it reduces the amount of pitch dispersing into water.

We have also found that, depending on the specific application, the peroxide dosage needed for bleaching aspen groundwood is substantially smaller than the peroxide dosage for spruce groundwood, which also by itself reduces the amount of water-soluble substance. Surprisingly the concentration of extractives on the surface of the bleached aspen groundwood (coverage of extractives) is not higher than for spruce groundwood, even if the total concentration of extractives in aspen groundwood is about twice that of spruce groundwood.

Concerning runability it is also essential to control dewatering. The use of aspen groundwood involves a significant risk in this aspect because its fiber size is small and generally the water retention of hardwood pulps is greater for them because of their characteristic carbohydrate composition than for softwood pulps. By means of the present invention it has become possible to avoid both of these factors which cause risks to runability. First, when aspen groundwood was prepared as described in Example 1, it was surprisingly found that the Freeness of aspen groundwood could be left on a higher level than is required from a spruce groundwood produced for the corresponding purpose. This is because the aspen groundwood contains only small amounts of shives and coarse fibers which would have required processing into a low Freeness. Secondly, dewatering of a paper web containing aspen groundwood is significantly promoted when the wet end is operated in compliance with the present invention.

When chemical aspen pulp is used for manufacturing traditional fine papers, the vasculum cells of aspen give rise to spots and stains on the paper machine. The defoaming agents used for controlling the process appear to cause flocculation of small vasculum cells. The flocs bind loosely to the surface of the paper web and then attach to the roll surfaces of the press section or to the cylinder surfaces of the drying section generating light spots on the surface of the paper. When these spots are examined under a microscope, flocs of vasculum cells can be found. Surprisingly, when mechanical aspen pulp is used no flocculation of vasculum cells has been noticed. This is probably because the physical (stiffness) and chemical (more hydrophobic surface) properties of mechanical fibers are different from those of the fibers in chemical pulps.

More specifically, the process according to the invention is a process for preparing a paper web, according to which process a stock is formed from a fibrous raw material, a web is formed from the stock, and the web is dried, characterized in that the stock is formed from bleached mechanical pulp prepared from wood raw material of the Populus family, the pH of the proportioning being adjusted to 6.8 to 7.2 and the pH of the machine pulp being adjusted to 7.1 to 7.5 and the conductivity of the stock being adjusted 1000 to 1500 $\mu$S/cm.

The present invention provides considerable advantages. Thus, by using a relatively low pH and a narrow pH range, the sensitivity to disturbances of the papermaking process can be reduced, because the amounts of dissolved disturbing substances drops and the variation of the amount grows smaller. Paper is produced in a system which is in a constant state of interaction and change, whereby the present method, i.e. the operation of the machine, which includes the above-mentioned characteristics creates a stable and readily controllable situation.

In comparison to the manufacture of traditional fine paper, the conductivity of the stock is kept on a high level of 1000 to 1500 $\mu$S/cm. Salts, in particular monovalent alkali metal ions, such as sodium and its salt derived from bleaching of the aspen pulp are responsible for the increase of the conductivity. The conductivity correlates with the sodium concentration of the process water. At high electrolyst concentration and high conductivity levels, variations in the electrolyst concentration (and conductivity) does not cause variations in the chemical phase equilibriums of the wet end nor is their influence on the dewatering on the paper machine as large as when operating at low conductivities (300 to 600 $\mu$S/cm of traditional fine papers). It is particularly advantageous to operate a high relative conductivity in connection with a mechanical aspen pulp having a high concentration of extractives. The high conductivity reduces the amount of carbohydrates dissolving from the pulp into water and, this way, also the amount of dispersing lipophilic extractives.

For bleaching of aspen groundwood, the required peroxide dosage is much smaller than for spruce groundwood, which reduces the amount of water solubles. The amount of extractives on the surface of the bleached aspen groundwood (the coverage of extractives determined by ESCA (Electron Spectroscopy for Chemical Analysis)) is not higher than for spruce groundwood.

The combination of high conductivity, narrow pH range and the small amounts of bivalent ions creates stable conditions at the wet end of the paper machine. Since the pH is over 7, calcium carbonate and similar calcium salts can be added as fillers and on the paper web without a substantial increase of the calcium concentration in the wire water.

The present invention utilizes hardwood fibers having a small fiber size for paper making. The dewatering of the prepared paper web is, however, by no means poor. On the contrary, a web containing aspen pulp is more readily dewatered than a web containing spruce groundwood. Surprisingly, it has been found that aspen can be ground to a higher Freeness level because smaller amounts of shives and coarse fibers are formed therefrom during grinding. Furthermore, in comparison to the manufacture of traditional fine papers, the relatively high conductivity promotes and stabilizes water removal.

According to a preferred embodiment of the invention, a mechanical pulp of aspen is combined with a chemical softwood pulp for preparing base paper for fine papers. Traditionally fine papers have been made entirely from chemical pulp. In comparison with this kind of fine paper making, the bleaching of the mechanical aspen pulp will give the machine a high conductivity level, which improves the stability of the wet end. It promotes water removal and increases stability of water removal. When a stock is produced containing about 30 to 60 wt-% aspen pulp having a brightness of 81 to 85%, the conductivity is about 1100 to 1600 $\mu$S/cm, which is clearly higher than for a conventional fine paper process (300 to 600 $\mu$S/cm).

The fact that the aspen pulp is readily dewatered makes it possible to achieve a surprisingly high, up to 48%, dry substance content after the press section. This improves runability of the drying section, which minimizes the tacking risks and steam requirements and increases the capacity of the paper machine.

With the aid of the invention it is possible to control the pitching problem much better with aspen than with spruce ground wood.

In summary, it should be pointed out that by the present invention relating to controlling of the chemistry of the wet end of the mechanical aspen pulp is is possible much better to control the runability of the paper machine, in particular when preparing a base paper for fine papers having high brightness and high opacity. Retention and the anionic character can be controlled by substances know per se. By means of the invention the aqueous amounts of LC substances and in particular lipophilic extractives which are detrimental to the runability of the machine can be restricted and the properties of the aspen pulp can be optimized by controlling the grinding and refining so that excellent dewatering can be reached. A more stable and more easily steered process is obtained. The invention also comprises the improvement of the dewatering of hardwood pulps by control of the electrolyst concentrations of process water. According to recent studies the electrolyst concentration/conductivity has a greater influence on the behavior of hardwood pulp, on the water retention of the pulp, than softwood pulp. Further it has been found possible to remove the sclerides which are known to be problematic and surprisingly the vasculum cells of mechanical aspen pulps do not cause any runability problems under these conditions. The invention significantly improves the possibilities of using mechanical aspen pulp for producing fine papers having high brightness and opacity.

The invention will be examined more closely with the aid of a detailed description and with reference to a number of working examples.

Figure 1:
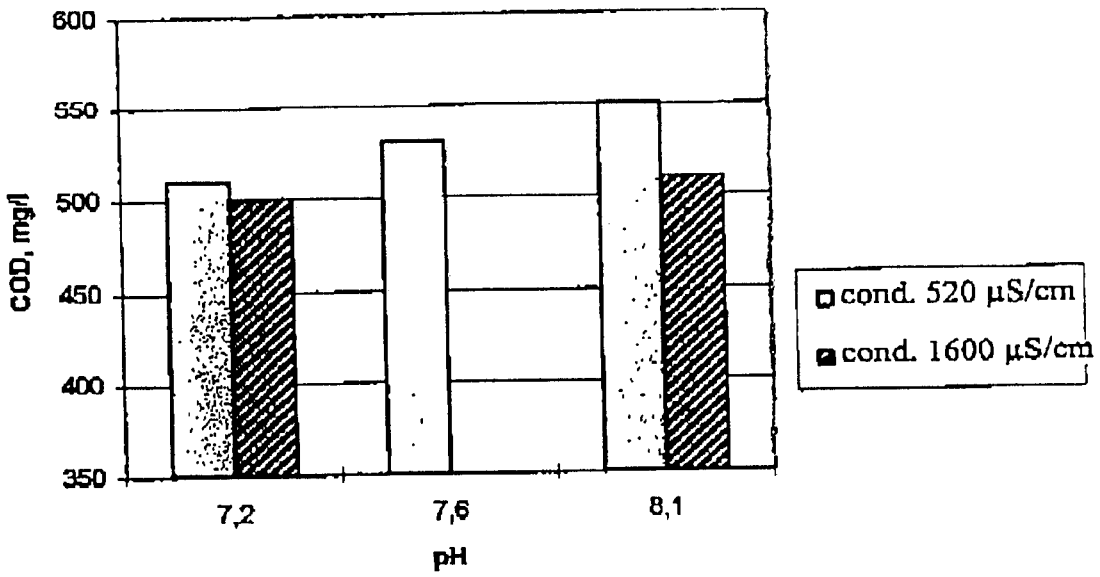
FIG. 1 depicts the COD of aspen ground wood vs. pH and conductivity.

According to the invention, the pulp is produced from *P. tremula, P. tremuloides, P. balsamea, P. balsamifera, P. trichocarpa* or *P. heterophylla.* Aspen (trembling aspen, *P. tremula;* Canadian aspen, *P. tremuloides*), or aspen varieties known as hyride aspens produced from different base aspens by hybridizing as well as other species produced by recombinant technology, or poplar. The raw material is used for producing groundwood (GW) or pressure groundwood (PGW) or it is disintegrated to form chips and the chips are used for producing thermomechanical pulp (TMP) or chemithermomechanical pulp (CTMP) by methods known per se.

Preferably the mechanical aspen pulp contains about 10 to 20% of +20 . . . +48 mesh fibers, which confer mechanical strength to the pulp. In order to maximize light scattering, the portion of +100, +200 and −200 fractions should be as large as possible. Preferably they stand for distinctly more than 50% of the whole pulp. In particular their proportion of the whole pulp is over 70%, preferably over 80%. On the other hand, the amount of the smallest fraction, i.e. the −200 mesh, should not be too large, because then dewatering on the paper machine would become more difficult. Preferably the proportion of this fraction is smaller than 50%, in particular 45% or less.

The mechanical pulp is bleached after grinding or refining, respectively. Preferably the pulp is peroxide bleached at alkaline conditions. According to a preferred embodiment the pulp is bleached with a one, two or multistage bleaching sequence, the pulp being acidified between the bleaching stages and the peroxide residue being reduced. Generally the peroxide dosage is about 2 to 3.5 weight-% of the dry matter of the pulp, for aspen pulp 0.5 to 1.5%, in particular 0.7 to 1.2%. A dithionite bleaching step comprising the treatment of the pulp with $Na_2S_2O_4$ can be incorporated into the peroxide bleaching sequence.

The mechanical pulp is washed before bleaching and after the bleaching with a mixture of water from the pulping section and clarified water from the paper machine in a washing press (filter press) by using typically about 0.1 to 10 $m^3$ water per ton of pulp. Water is removed from the pulp with the washing press, in order to increase the dry matter content of pulp from about 4 to 5% to about 20 to 30%. The effluent of the water removal are recycled to the mechanical pulp production. By means of the washing press impurities can be prevented from being transferred to the paper machine.

We have found that there is a linear correlation between the conductivity of the pulp and the Na concentration. The dosages of bleaching chemicals and the displacement ratio during washing regulate the conductivity level on the paper machine. The sodium ions are accompanied by silicates which also have an influence on the conductivity.

The bleached pulp is then refined to the desired degree of beating, which is, e.g. 30 to 100 CSF (Canadian Standard Freeness), preferably about 40 to 80 CSF.

A stock is formed from the mechanical pulp together with a chemical pulp. The stock can contain other fiber materials and additives, such as fillers. Calcium carbonate, talcum and kaolin are examples of fillers. The dry matter content of the stock is about 0.1 to 5%. Clarified filtrate of a circulating water of the paper machine is used as the aqueous phase of the stock.

A fully bleached chemical softwood pulp is preferably added to the stock, whereby a paper web suitable as a base paper of fine papers is obtained. Said web has a high bulk, high brightness and high opacity and good formation. The amount of the mechanical pulp is then for example 20 to 70 weight-%, preferably 30 to 50 weight-%, and the amount of the bleached softwood pulp is for example 80 to 30 weight-%, preferably 70 to 50 weight-% of the dry matter of the stock.

The pH of the proportioning stock is set at 6.8 to 7.2 and the pH of the machine pulp at 7.1 to 7.5, preferably at about 7.1 to 7.3. If necessary a suitable base or acid is used for setting the pH and for adjusting the pH during paper making. The bases used comprise in particular alkali metal bicarbonates or carbonates and alkali metal hydroxides. The acids used include mineral acids and acid salts. The preferred acids are sulphuric acid and its acid salts such as alum, and the preferred base is sodium bicarbonate.

A paper web is produced from the fibrous stock on a paper machine in a manner known per se. A preferred embodiment comprises in particular producing a base paper of finer papers having the following composition: 30 to 50 weight-% of its fibrous substance comprises mechanical pulp produced from aspen and 70 to 50 weight-% comprises chemical softwood pulp.

The solution according to the invention is particularly well suited to coating wherein calcium carbonate is used as a pigment of the coating colours. p The following non-limiting examples illustrate the invention:

EXAMPLE 1

Manufacture of Aspen Groundwood on a Pilot Apparatus

Pressure groundwood was prepared with a pressurized PGW70 process. The pulps were ground with a grinding stone having an average grain size of 73 mesh. The grindings were carried out with a one oven pilot grinder. The grinder was operated using the following settings:

Inner pressure of grinder: 250 kPa,

Flow of water jet: about 3.5 l/s (aimed consistency about 1.5%)

Temperature of water jet: 70° C.

The ground pulp was processed to a finished, bleached and postrefined pulp. The processing was performed sequentially as follows:

Mainline screening;

High-consistency refining of reject in two stages;

Screening of refined reject;

Combination of mainline and reject line aspects;

Two-stage bleaching with peroxide+dithionite;

Postrefinings

The screening of the pulp was made using fractionating slit screening technique. The refining of the reject was carried out at high consistency in two stages. In both refining stage the reject was precipitated before grinding with a twin fabric press and diluted after the grinding with the effluent of the press. The reject refiner was provided with knives for high-consistency refining of pulp. Samples were taken after both refining steps. After the first step the sample was subjected to disintegration on a sample web and after the second step the disintegration was made in a container. The paper technical properties were only determined from the sample taken after the second refining step. The screening of the refined reject was made in a manner known per se.

The pulps were bleached with a two-stage peroxide and hydrosulphide bleaching in two batches.

First the pulp which were to be bleached were precipitated on a belt filter, and then they were fed to a high-consistency refiner operated with a rather large knife slit which was used as a chemical mixer. The peroxide solution which contained all bleaching chemicals was fed as screw water of the feed screw of the refiner. From the refiner the pulp was filled into large sacs in which the pulp was kept for about two hours.

The aimed bleaching chemical dosage (90% of production) was:

| | |
|---|---|
| $H_2O_2$ | 1.5%, usually 0.8–1% |
| NaOH | 1.0% |
| $Na_2SiO_3$ | 3.5% |
| DTPA | 0.5% |

DTPA was dosed mixed with the bleaching liquid.

The acidification of the pulp was carried out with a 93% sulphuric acid which was diluted with water at the ratio 1:10. The diluted acid was dosed to the bleaching pulp 8 l per sac.

From the slushed and acidified pulp, CSF, shives, BmcN-fractions and brightness were determined. During double-bleaching the peroxide residue was reduced after acidification by adding to the pulp in a pulper 1.33 kg sodium sulphate per sac. Then the pH was set at 6.5 by adding 50% sodium hydroxide. In the previous test runs the aimed pH value was 6.0.

After this, a 10% $Na_2S_2O_4$ solution were added for performing the dithionite bleaching. The dosing was 0.6%. From the second bleaching batch pulp and paper technical properties were determined after double bleaching.

The postrefining was carried out at low consistency with a Tampella T224 disc refiner. The pulp was refined at about 70 k Wh/t specific energy consumption. The drainage of the finished pulp was 50 ml CSF.

The fiber size distribution of the pulp was the following:

| Fiber fraction | Percentage |
|---|---|
| +14 | 0% |
| +28 | 1.6% |
| +48 | 16.0% |
| +200 | 43.0% |
| −200 | 39.4% |

EXAMPLE 2

Runability of Aspen Groundwood

The amount of COD dissolving from the pulp prepared in Example 1 as a function of pH and conductivity was examined in this example. The results are given in FIGS. 1 to 3. FIG. 1 depicts in the form of a bar chart the amount of soluble COD's at pH 7.2, 7.6 and 8.1 for two different conductivity levels, viz. 520 and 1600 $\mu$S/cm. A corresponding presentation of the influence of pH and conductivity on LC turbidity is shown in FIG. 2 and on the anionic character in FIG. 3.

As FIG. 1 shows, as pH rises the amount of dissolved COD grows and at low conductivity more impurities are dissolved than at higher conductivity. Similarly an increase of pH leads to a corresponding increase of the amount of anionic substance dissolved from aspen groundwood (cf. FIG. 3). At low conductivities the amount of dissolved anionic substance is greater than at higher conductivity.

Low pH, narrow pH range and higher conductivity decreases the sensitivity of the process to disturbances because the amounts of liquid and colloidal disturbing substances are smaller.

Figure 2:
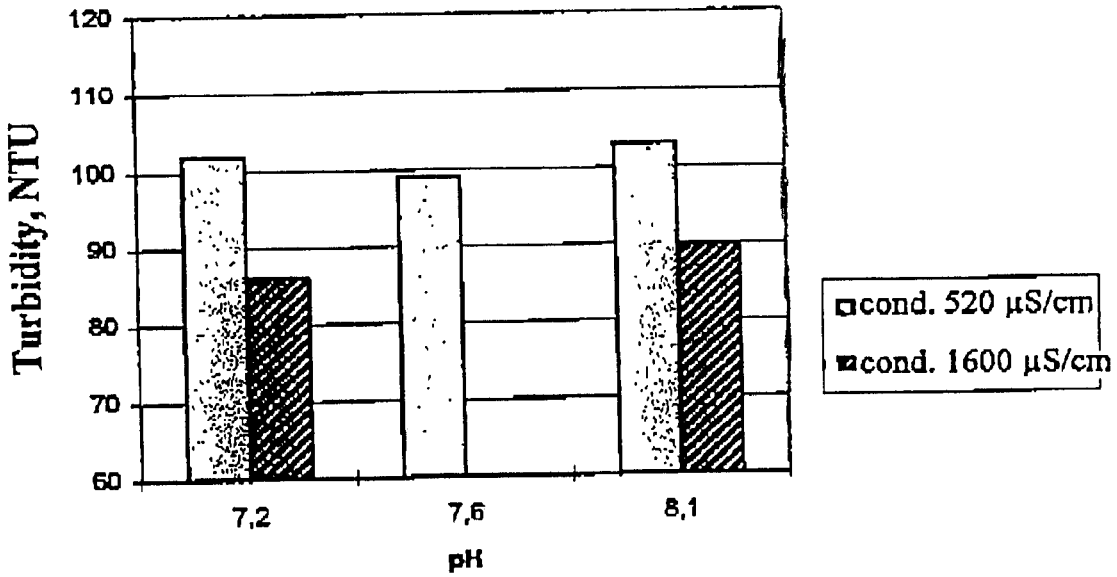
FIG. 2 shows the LC turbidity of aspen ground wood vs. pH and conductivity.
Figure 3:
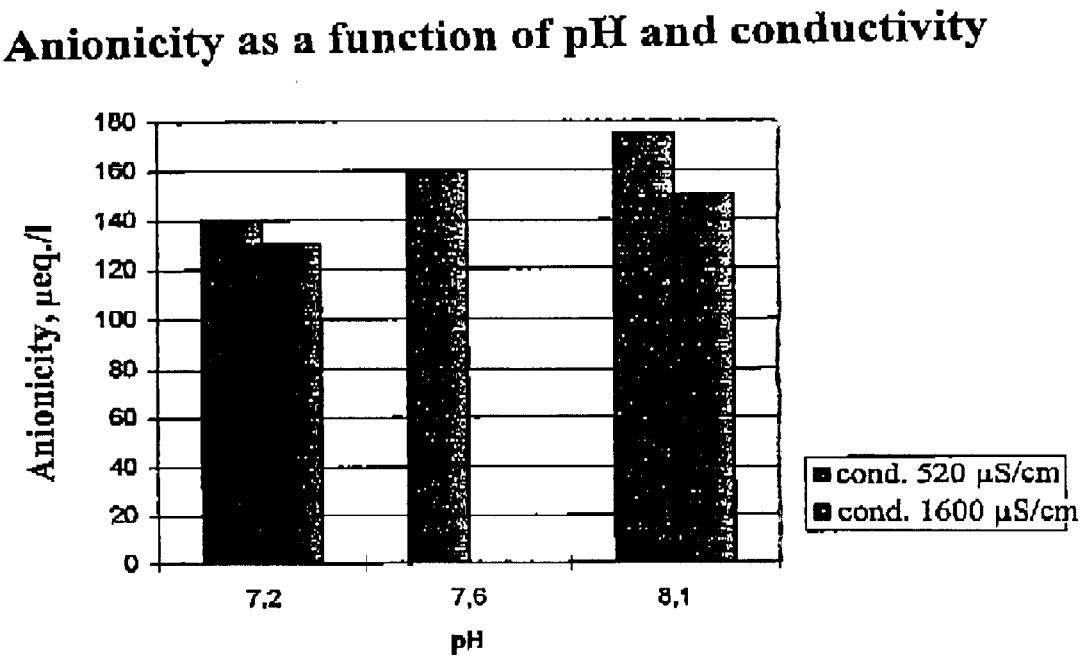
FIG. 3 shows the anionic character of aspen ground wood vs. pH and conductivity.

FIG. 2 shows the dependency of LC turbidity on pH and conductivity. There is a linear correlation between LC turbidity measured from the centrifuged filtrate with the concentration of pitch present in the solution in the form of a stable dispersion. It is apparent from the figure that there are less pitch substances dispersed in water at higher conductivities than at lower conductivities.

EXAMPLE 3

Dewatering of Mixed Pulp

Dewatering of mixed pulps containing spruce and aspen groundwood, respectively, were compared using the Dynamic Drainage Analyzer technique (DDA) as follows:

The chemical pulp was a bleached pine kraft which had been refined in two different ways: as such (not fractionated)

and fractionated with separate refining of the accept and reject fractions. The drainage resistance of the pulp comprising mixtures of separately refined accepts and rejects was the same as for the refined non-fractionated pulp, i.e. 340 ml (CSF). The drainability of the spruce groundwood was <20 ml CSF and that of aspen groundwood 33 ml CSF. Pulp mixtures containing 60% chemical pulp, 40% groundwood and about 10% carbonate filler (Filler L) and 0.8% pulp starch. The pH of the pulps was in the range of 7 to 7.5 and the conductivity 400 to 500 μS/cm, which value was adjusted, if necessary, by adding NACl.

Figure 4:
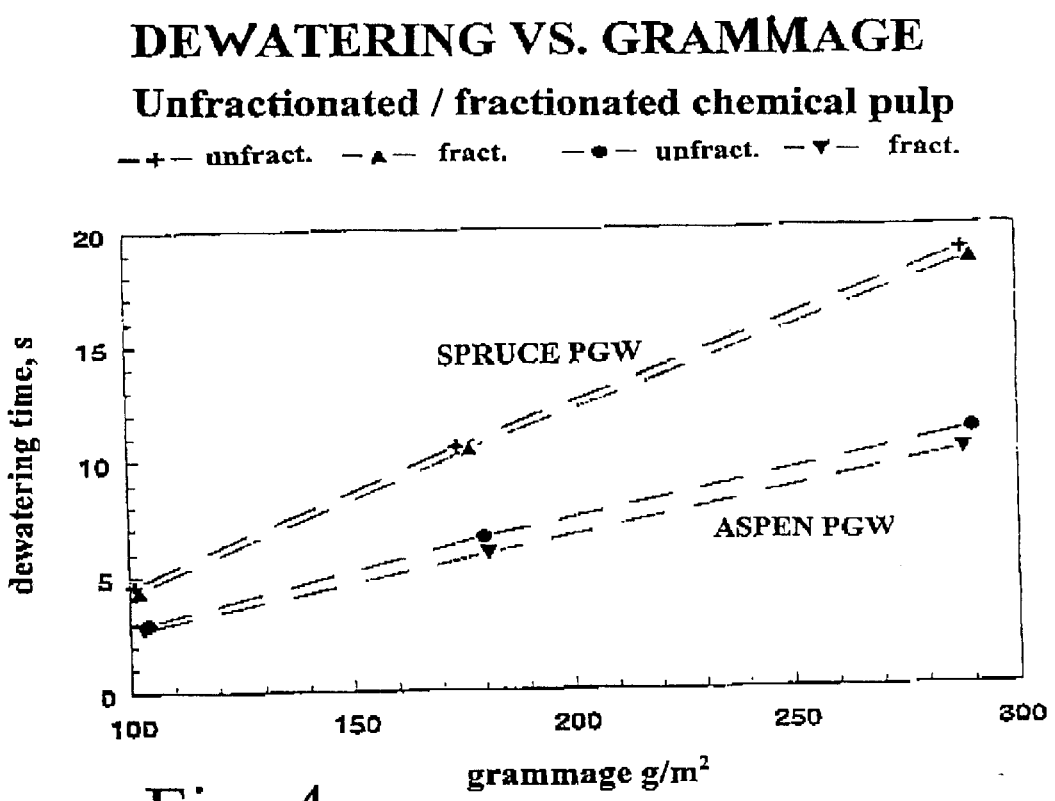
FIG. 4 shows the dewatering time of mixtures of mechanical spruce and aspen pulps, respectively with chemical pine pulp vs. grammage of paper sheet measured with a DDA.
Figure 5:
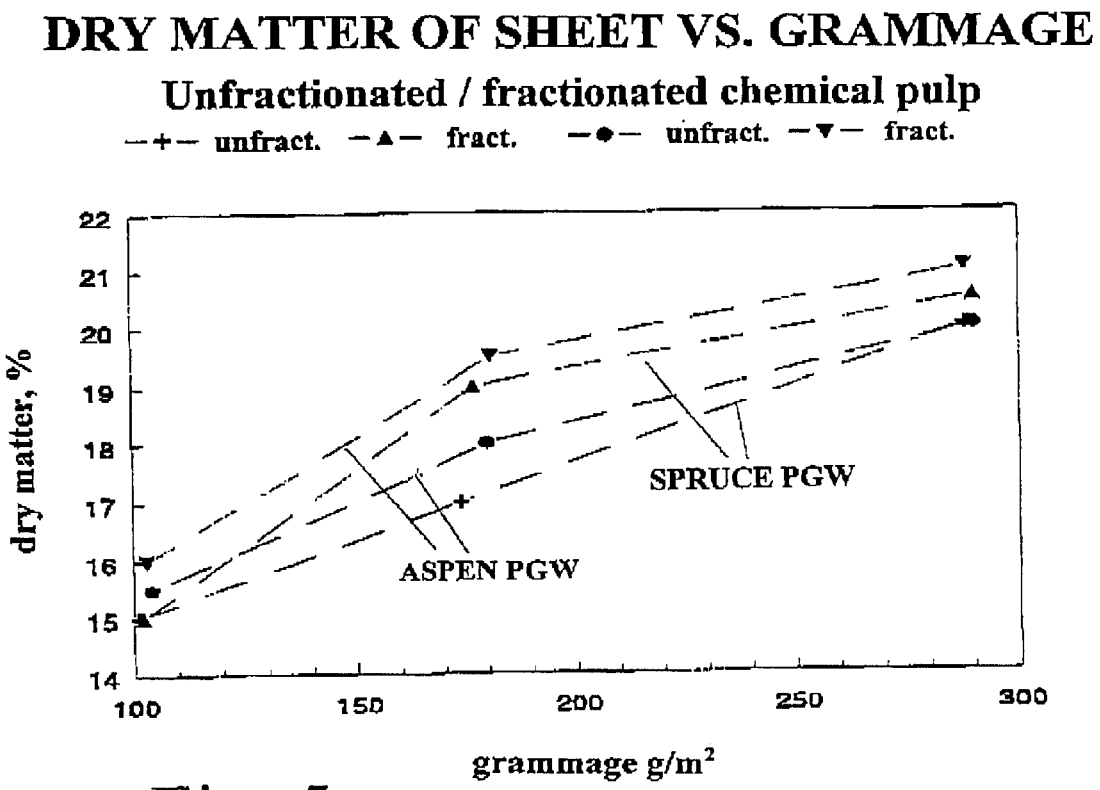
FIG. 5 depicts the dry matter contents of mixtures of mechanical spruce and aspen pulps, respectively with chemical pine pulp vs. grammage of paper sheet measured with a DDA.

The dewatering times and the dry matter concentration of the sheet was determined by the DDA technique. The Dynamic Drainage Analyzer apparatus is used for simulating dewater on the wire section (to the water level) of the paper machine. The results are shown in FIGS. 4 and 5.

As will appear from the figures, spruce groundwood gives essentially longer dewatering times than aspen groundwood. The dry matter content of a paper sheet made from aspen groundwood is clearly higher than for spruce groundwood. The results indicate that the dewatering properties of a paper web comprising mechanical aspen pulp, and thus the runability properties, are better than for a traditional spruce groundwood based paper.

EXAMPLE 4

Production of a Base Paper for Fine Papers

A base paper was produced from a mechanical aspen pulp (GW) and chemical pine pulp, which were mixed at a weight ratio of 40 to 60. Ground calcium carbonate was added as a filler to the stock in an amount of about 10% of the fibrous material.

The base paper was produced on a gap former. The properties of the base paper were the following:

| | |
|---|---|
| grammage | 53.3 g/m$^3$ |
| bulk | 1.45 cm$^3$/g |
| opacity | 88% |
| brightness | 82.5% |
| coarseness | 240 ml/min |
| porosity | 170 ml/min |
| filler content | 12% |

No problems with the runability of the base paper were encountered.

What is claimed is:

1. A process for preparing a paper web comprising forming a stock from fibrous raw material, forming a machine pulp from said stock, forming a web from said machine pulp, and drying said formed web, wherein said stock comprises bleached mechanical pulp prepared from the Populus family, the pH of said stock is 6.8 to 7.2, the pH of said machine pulp is 7.1 to 7.5, and the conductivity of said stock is 1000 to 1600 μS/cm.

2. The process according to claim 1, wherein the pH of said stock is pH 7.0–7.2.

3. The process according to claim 1, wherein said mechanical pulp is groundwood (GW), pressure groundwood (PGW), thermomechanical pulp (TMP) or chemimechanical pulp (CTMP).

4. The process according to claim 3, wherein said mechanical pulp is peroxide bleached.

5. The process according to claim 1, wherein said stock comprises a suspension, said suspension comprising said mechanical pulp, said suspension further comprising talcum, kaolin or calcium carbonate as a filler and, wherein said suspension has a dry matter content of about 0.1 to 5%.

6. The process according to claim 1, wherein said stock comprises mechanical pulp and bleached chemical soft wood pulp.

7. The process according to claim 6, wherein mechanical pulp comprises 20 to 70 wt-% and chemical softwood pulp comprises 80 to 30 wt-% of the dry matter of said stock.

8. The process according to claim 1, wherein said mechanical pulp is washed before and/or after bleaching, and wherein the dry matter content of said pulp is raised from 4 to 5% to 20 to 30%.

9. The process according to claim 8, wherein said mechanical pulp is washed and dewatered on a fabric press.

10. The process according to claim 8 or claim 9, wherein the water from the dewatering cycle is recycled back to the preparation of mechanical pulp.

11. The process according to claim 1, wherein alkali metal hydroxide, alkali metal bicarbonate, or mineral acid or an acid salt are used to adjust the pH of said stock.

12. The process according to claim 1, wherein said mechanical pulp is from *P. tremula, P. tremuloides, P. balsamea, P. balsamifera, P. trichocarpa* or *P. heterophylla.*

13. The process according to claim 1, wherein said paper web is coated with a coating color comprising calcium carbonate.

14. The process according to claim 7, wherein mechanical pulp comprises 30 to 60 wt-% and chemical softwood pulp comprises 70 to 40 wt-% of the dry matter of said stock.

15. A process for preparing a paper web comprising forming a stock from fibrous raw material, forming a machine pulp from said stock, forming a web from said machine pulp, and drying said formed web, wherein said stock comprises, in terms of dry matter, 20 to 70 wt-% bleached mechanical pulp prepared from the Populus family and 80 to 30 wt-% bleached chemical softwood pulp, the pH of said stock is 6.8 to 7.2, the pH of said machine pulp is 7.1 to 7.5, and, the conductivity of said stock is 1000 to 1600 μS/cm.

* * * * *